United States Patent [19]

Buckley et al.

[11] 4,186,841

[45] Feb. 5, 1980

[54] PALLET

[75] Inventors: Albert P. Buckley, Cohasset; Melville R. Dill, Jr., Boston, both of Mass.

[73] Assignee: Federal Reserve Bank of Boston, Boston, Mass.

[21] Appl. No.: 837,739

[22] Filed: Sep. 29, 1977

[51] Int. Cl.[2] ..... B65D 7/26; B65D 21/02

[52] U.S. Cl. ..... 220/6; 220/4 F; 220/7; 206/511; 206/512; 220/1.5

[58] Field of Search ..... 220/4 F, 6, 7, 1.5; 206/511, 512

[56] References Cited

U.S. PATENT DOCUMENTS

| | | | |
|---|---|---|---|
| 2,669,373 | 2/1954 | Coit | 220/7 |
| 2,780,382 | 2/1957 | Beckner | 220/6 |
| 2,956,763 | 10/1976 | D'Arca | 220/6 |
| 3,981,410 | 9/1976 | Schurch | 220/6 |

FOREIGN PATENT DOCUMENTS

| | | | |
|---|---|---|---|
| 142767 | 6/1946 | Australia | 220/6 |

*Primary Examiner*—George E. Lawrence

*Attorney, Agent, or Firm*—Weingarten, Maxham & Schurgin

[57] ABSTRACT

A foldable, stackable pallet suitable for dense objects, such as bags of coins. The pallet has two removable side walls which can be stored flat beneath folded end walls which are erected by a pair of depending plates having vertical slots engaging transverse pivots.

11 Claims, 8 Drawing Figures

PALLET

BACKGROUND OF THE INVENTION

This invention deals with a pallet or storage rack. In particular, it deals with a foldable, stackable pallet having solid side walls so as to be usable for the storage of coins and the like in a bank.

Foldable storage racks or pallets having grate-like walls have been previously described, as for example, U.S. Pat. Nos. 3,499,398 and 3,565,018. Such pallets, while usable for large, bulky objects, cannot be used with dense objects such as bags of coins and further are bulky and difficult to stack. In addition, prior art foldable pallets are limited as to the directions they can be used with lifts and conveyors.

One object of the present invention is to provide a maintenance-free, sturdy, foldable pallet which can be used for dense objects but is also stackable in extended condition and compactly stackable in folded condition and which can be used with lifts and conveyors in many directions.

Further objects and advantages of this invention will be apparent from the description and claims which follow taken together with the appended drawings.

SUMMARY OF INVENTION

This invention comprises generally a pallet having a support frame and four support corner feet mounted on said frame and extending below the base of said frame to form wide enough lower spaces so as to be handled by a conventional fork-lift from the sides or ends or a low-lift skid lifter from the sides. There are two inwardly foldable end walls which lie flat when folded and two removable side walls which can be stored flat beneath the folded end walls without interfering with the stacking or nesting of the folded pallets. The side walls when erected sit in a channel along the edge of the frame. Each foldable end wall comprises a panel extending between two support columns. Each support foot and support column has a protrusion on its upper end and side walls forming a hollow space on its lower end. A protrusion is registrable with the walls of the lower end to form a rigid, vertical connection.

Each support column is pivotally attached to its support foot by means of a pair of depending plates having vertical slots engaging transverse pivots extending from the feet into the slots.

The four corner support feet have square corners at their bases which enhances guiding when used in a pallet conveyor. A bottom plate is provided for the support feet on each end, which permits the pallet to ride either longitudinally or transversely. The flat folding of the end walls into the previously stored side walls, with the four corner post protrusions or nesting plugs permits compact spacing and nesting of folded pallets. Three folded pallets can be stacked in the space occupied by one extended pallet.

The slotted plate pivotal attachment of the support column to a pin in its support foot permits the use of a larger, vertical dimension for the side panel for the same length panel than prior art foldable pallets.

Another feature of the invention is a handle-latch on each end of a side panel. The handle-latches permit the use of the side panel as a lever to push in and lock the contents (e.g. coin bags) with a top stop.

SPECIFIC EXAMPLE OF INVENTION

Figure 1:
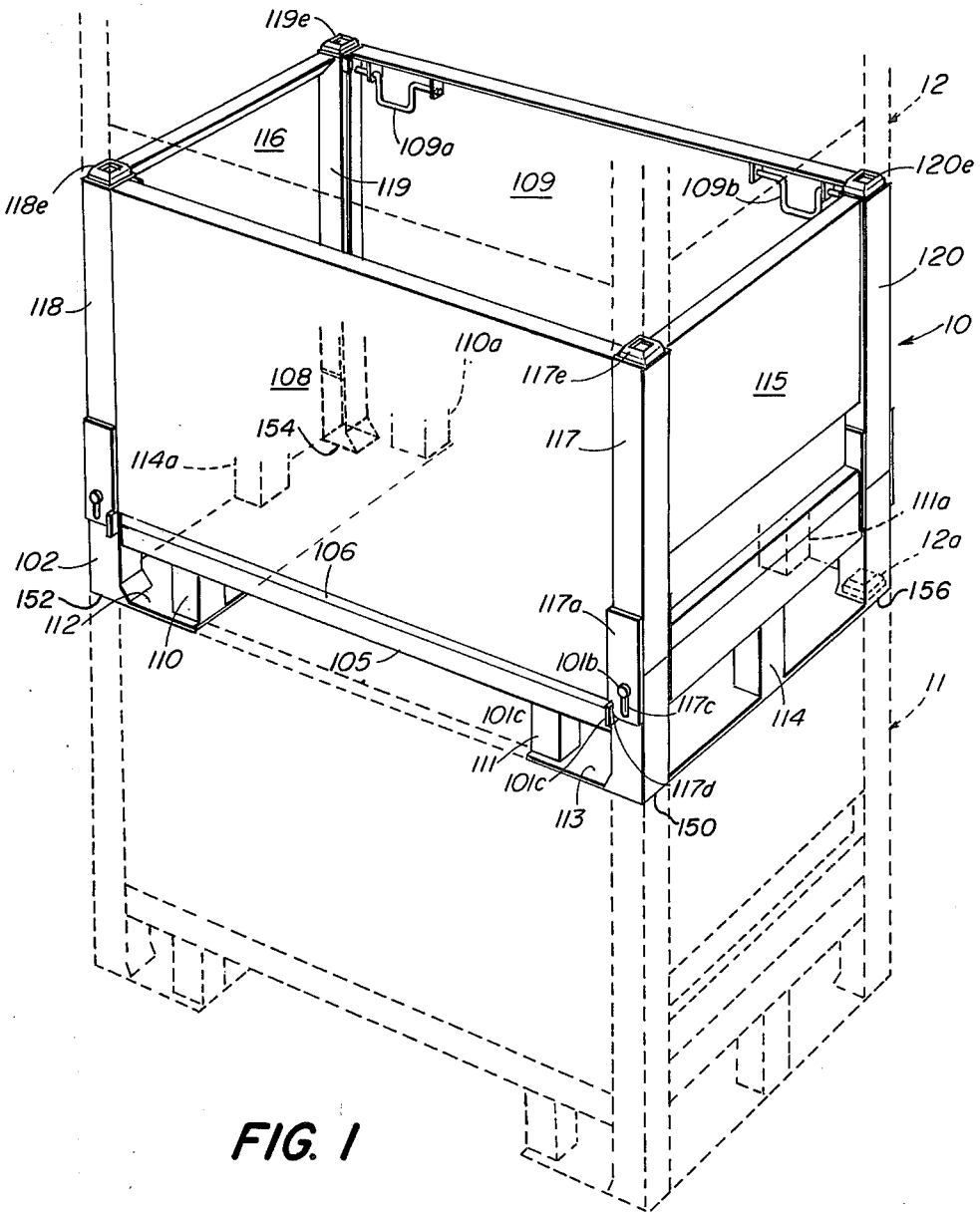
FIG. 1 is a perspective view of a pallet made in accordance with this invention shown stacked on a similar pallet shown in phantom.

The specific example of the invention shown in the drawings is illustrated by pallets 10, shown in detail both extended and folded condition in conjunction with phantom pallets 11 and 12.

Pallet 10 comprises a support frame 105 having a pair of base plates 112 and 113. Vertical supports 110, 110*a*, 111, 111*a*, 114, 114*a*, extend from the base plates to a flat upper surface 105*a*. Mounted on each corner of the frame 105 are hollow support feet 101, 102, 103 and 104, which also extend from the base plates but go above the upper surface of the frame. The top portion of each of these support feet comprises a body portion 101*a* and a block member or nesting plug 101*aa*, which extends into the hollow top portion of the foot and also extends upwardly to form a protrusion having a chamfered surface 101*ab*. A transverse pivot pin 101*b* having an enlarged head is provided on each side of each foot.

Figure 4A:
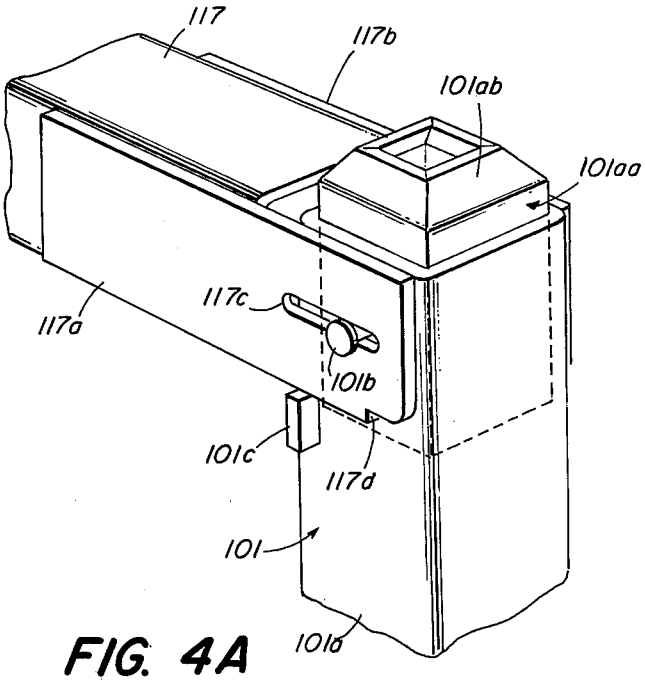
FIG. 4*a* shows an enlarged cutaway perspective between the support column and support foot when the end wall is in folded condition.
Figure 4B:
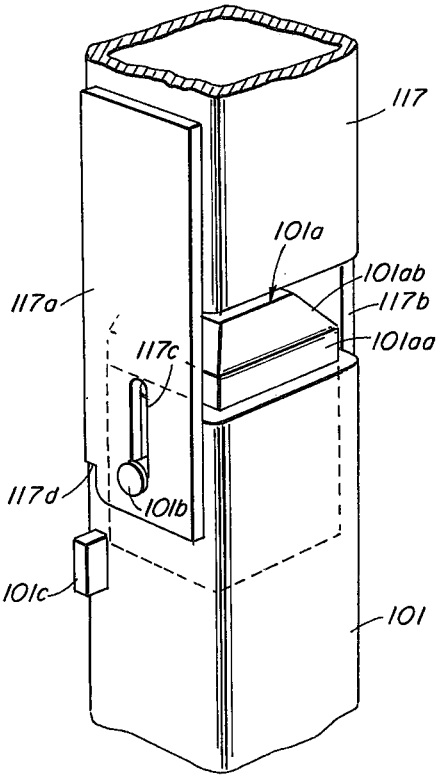
FIG. 4*b* shows the support column in upper extended position, either folding or locking.
Figure 4C:
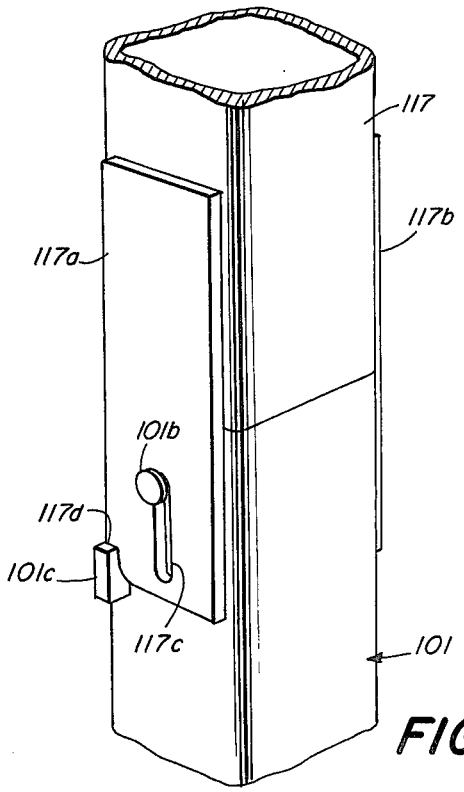
FIG. 4*c* shows the support column and support foot in rigid lock position.
Figure 5:
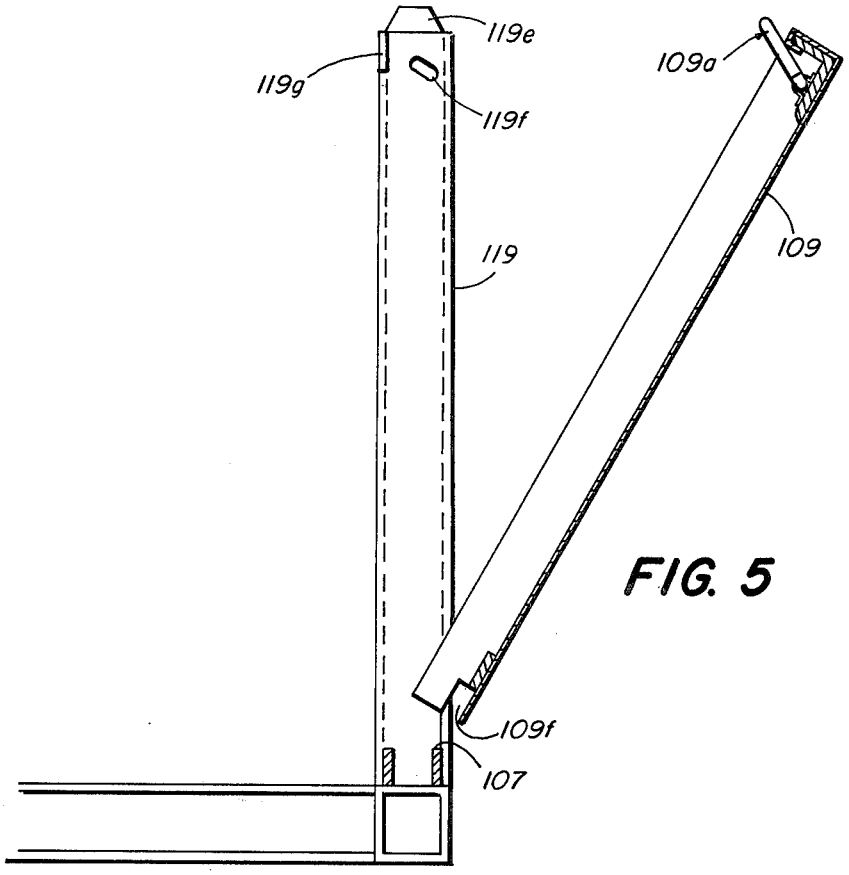
FIG. 5 is a partial enlarged end view showing a side panel ready to be placed in position.
Figure 6:
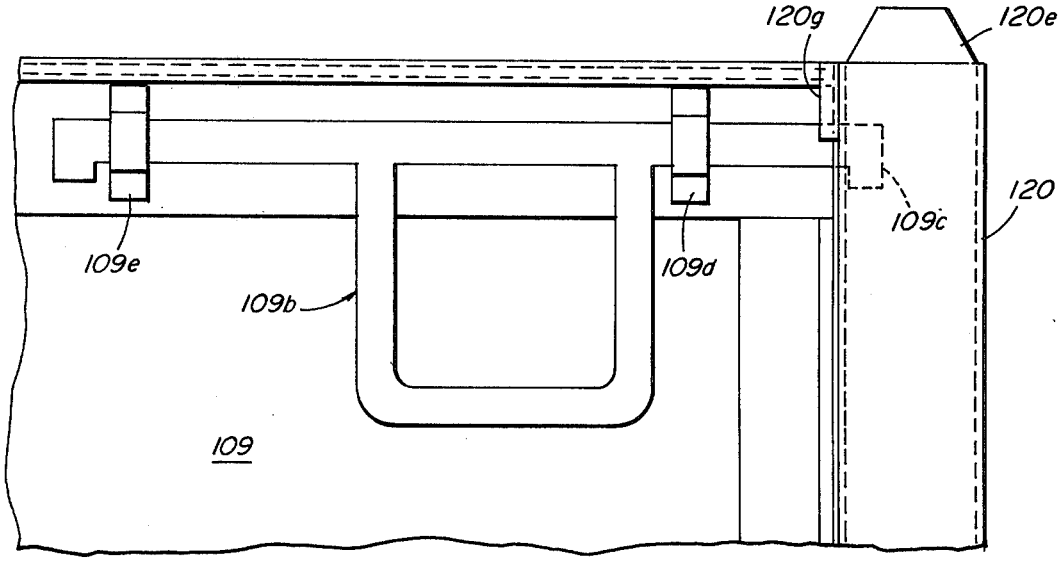
FIG. 6 is partial enlarged view of a portion of FIG. 1 showing the locking action of the handle on the side panel with partial cutaway.

Pivotally engagable with each pair of support feet 101–104 and 102–103 are pairs of support columns 117–120, and 118–119 supporting end walls 115 and 116 respectively. Each pair of support columns form the ends of the end walls 115 and 116, and each column has a pair of plates 117*a* and 117*b* on opposite surfaces which extend downward so that their vertical slots 117*c* are engagable with transverse pivot pin 101*b* to provide the pivotal connection. An end notch 117*d* is provided in the depending plate 117*a* which when it engages the stop 101*c* on foot 101 provides a secure lock in the rigid connection illustrated in FIG. 4*c*.

The inner walls of the hollow bottom end of the support column 117 fit tightly onto the protruding walls of the nesting plug so that the combination of the protrusion fit, pin engagement in the slot and notch engagement on the stop provides a rigid, safe connection.

Figure 2:
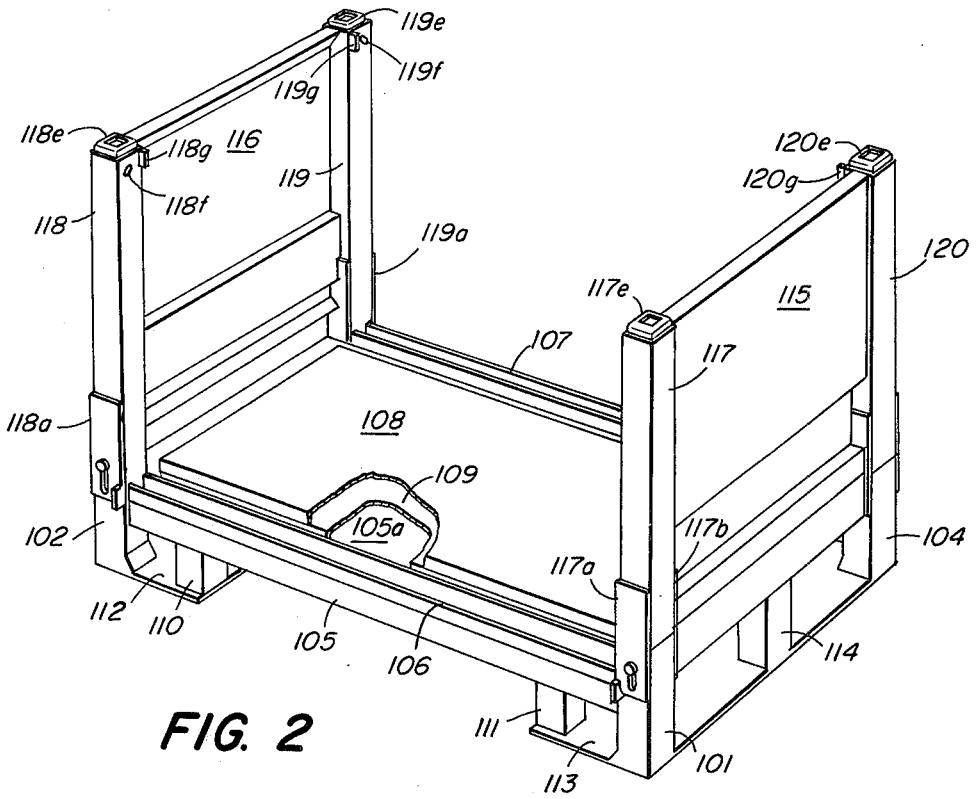
FIG. 2 is a perspective view with partial cutaway showing the side walls which have been lifted up and placed on the bed of the frame, with the end walls still in extended position.
Figure 3:
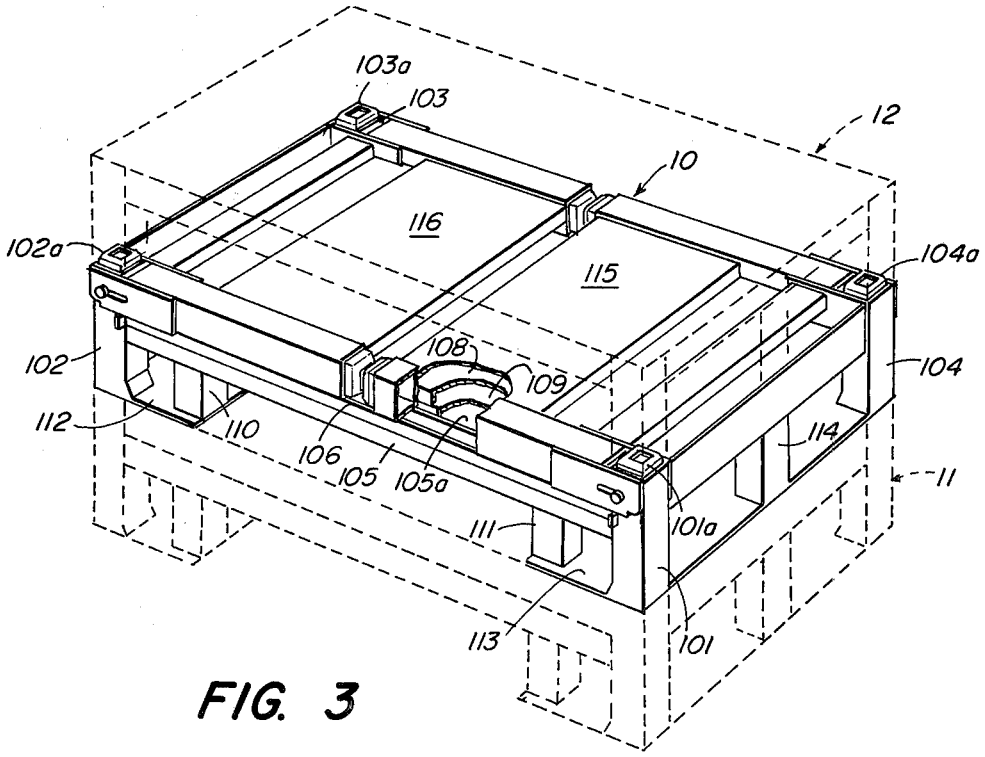
FIG. 3 is a perspective view in which the pallet of FIG. 1 and 2 now has its end walls folded in so as to be in its most compact condition, showing similar compacted pallets above and below in phantom.

The protrusions 117*e* and 120*e* are similar in shape and size as those on top of the feet so that the pallets of this invention are rigidly stackable upon one another when in extended or folded condition. Support feet 101, 102, 103 and 104 each have recesses with openings 150, 152, 154 and 156 respectively adapted to receive mating protrusions 117*e*, 118*e*, 119*e* and 120*e* or protrusions 101*a*, 102*a*, 103*a* and 104*a* of another pallet in a stacked position therebelow. Openings 150, 152, 154 and 156 are inwardly flared at the lower ends thereof, as shown in FIGS. 1–3, thereby permitting pallet 10 to be stacked upon another pallet without requiring precise positioning of openings 150, 152, 154 and 156 over the respective protrusions. The flared openings of the recesses do not extend beyond the side edges of plates 112 and 113 so that there is no interference with the movement of the pallets by conveyor belt or with side-by-side storage of the pallets.

By virtue of the construction described, the pallet 10 has a pair of removable side walls panels 108 and 109. The side wall panels are positioned in channels 106 and 107 which are located on the edges of plate 105*a*. The side walls, as for example, side wall 109, has handles 109*a* and 109*b* which are slidable in loops 109*d* and 109*e* to engage and lock in a slot 119*f* in conbinsation with stop 119*g* and post 119. The positioning of the side panel is aided by a notch 109*f* which permits the side panel to go over one wall of the channel 107.

By using this notch and side of the channel as a fulcrum, the side wall 109*c* by means of the handle can be used to push dense materials such as bags of coins into the pallet and then lock the panel by sliding the handle into the slot.

The side panels are easily removable by sliding the handles inwardly and lifting. They are stacked on the top plate 105 of the base and then the end walls 115 and 116 can be lifted up and folded inward as shown in FIG. 3. It should be noted that the end walls fit flat on top of the side walls so that there is no interference with nesting or stacking. The protrusions or nesting plugs 101*a* to 104*a* thus serve both for nesting and stacking and also for locking the support columns 117 to 120 into upright position.

The square corners at the base of each support foot 101 to 104 give guidance for use on a conveyor. A skid lifter can be used from the side and a fork-lifter can be used from either the side or either end in handling the pallet of this invention. Further, there is conveyorability in two directions.

We claim:

1. A foldable, stackable pallet comprising:

(a) a support frame;

(b) a plurality of support feet associated with said frame, each having a substantially rectangular cross section;

(c) two inwardly foldable end walls;

(d) first and second pairs of support columns, each pair associated with a respective one of said end walls and each column having a substantially rectangular cross section;

(e) means for pivotally attaching each of said support columns to a respective one of said support feet;

(f) a pair of removable side walls which are storable on said frame;

each of said support feet and each of said columns having an upwardly extending protrusion formed on an upper end thereof and a cooperative recess formed on a lower end thereof and defined by side walls thereof;

the recess formed on each of said support feet being adapted to selectively receive a protrusion formed on an upward end of a corresponding one of said columns of another pallet stacked therebelow in an extended condition and a protrusion formed on an upward end of a corresponding one of said support feet of another pallet stacked therebelow in a folded condition;

the recess on each of said columns being registrable with a protrusion formed on an upper end of an associated one of said support feet to form a rigid, vertical connection therebetween;

said pivotable attachment means comprising:

a pair of depending plates externally disposed on opposite sides of each of said columns and extending downwardly therefrom to engage the corresponding sides of an associated support foot therebetween;

an elongated slot in at least one plate of each pair of plates and extending longitudinally of the plate;

a transverse pivot pin disposed on each of said support feet and extending therefrom through a respective one of said slots;

a notch formed in at least one plate of each pair of plates; and a stop registrable with said notch when the recess on said support column is registered with the protrusion in said associated support foot;

said stop, said notch, said pivot pin, said slot, said recess in said support column and said protrusion on said support foot in combination being operable to produce said rigid vertical connection.

2. The pallet of claim 1 wherein said end walls lie flat without over-lapping one another when folded inwardly and said side walls are stored below said end walls, so that there is no interference with storing.

3. The pallet of claim 1 wherein channels are provided on said frame for positioning said side walls, said side walls having slidable top handles and said support columns having means for engaging said slidable handles so as to fasten said side walls to said columns.

4. The pallet of claim 1 wherein channels are provided in said frame for positioning said side walls and which cooperate with said side walls so as to be usable to force the contents into said container.

5. The pallet of claim 1 wherein the corners have straight, vertical sides for guiding or riding on a conveyor.

6. The pallet of claim 1 wherein the protrusions of said feet and columns are registrable with the bottom, hollow spaces of either a foot or a column so that the pallets are nestable upon one another whether in extended or folded condition.

7. The pallet of claim 6 wherein three folded pallets are stackable in the space of one fully extended pallet.

8. The pallet of claim 1 wherein said support frame includes bottom plates associated with said support feet and spaced so as to permit insertion of low-lift equipment and movement of the pallet either longitudinally or transversely.

9. The pallet of claim 1 wherein said support feet have square corners at their bases to assist in use with a conveyor.

10. The pallet of claim 1 wherein said recess formed in each of said plurality of support feet has an opening which is flared to permit reception therein of an imprecisely positioned mating projection, said flared opening not extending beyond external boundaries of said support foot.

11. The pallet of claim 1 wherein the upwardly extending portions of said protrusions are chamfered to permit ease of insertion of said protrusion into a mating recess.

* * * * *